US006152628A

United States Patent [19]

Satoh et al.

[11] Patent Number: 6,152,628

[45] Date of Patent: Nov. 28, 2000

[54] SHEET SUPPLY APPARATUS WITH FEED PROTRUSIONS FOR SKEW CORRECTION

[75] Inventors: Fumihiro Satoh; Haruhiko Yashima; Shigeki Sakakura, all of Inagi, Japan

[73] Assignees: Fujitsu Limited, Kawasaki; Fujitsu Isotec Limited, Tokyo, both of Japan

[21] Appl. No.: 09/223,966

[22] Filed: Dec. 31, 1998

[30] Foreign Application Priority Data

Mar. 20, 1998 [JP] Japan ..... 10-071644

[51] Int. Cl.[7] ..... B41J 13/03; B41J 13/28

[52] U.S. Cl. ..... 400/579; 400/630; 400/24; 400/26; 271/226; 271/227; 271/242

[58] Field of Search ..... 271/226, 227, 271/242, 182, 114; 400/579, 630, 631, 632, 632.1, 24, 25, 26, 27, 28; 492/30, 31, 38, 39

[56] References Cited

U.S. PATENT DOCUMENTS

| | | | |
|---|---|---|---|
| 4,870,258 | 9/1989 | Mochizuki et al. | 400/25 |
| 4,986,525 | 1/1991 | Takagi et al. | 271/114 |
| 5,088,848 | 2/1992 | De Falco et al. | 400/630 |
| 5,188,350 | 2/1993 | Hayashi | 271/114 |
| 5,222,724 | 6/1993 | Hirano et al. | 271/10 |
| 5,462,373 | 10/1995 | Chia | 400/62.4 |
| 5,466,079 | 11/1995 | Quintana | 400/579 |
| 5,547,181 | 8/1996 | Underwood | 271/114 |
| 5,725,319 | 3/1998 | Saito et al. | 400/629 |
| 5,813,782 | 9/1998 | Mason | 400/636 |
| 5,816,722 | 10/1998 | Fujiwara et al. | 400/605 |
| 5,859,653 | 1/1999 | Aoki et al. | 347/8 |
| 5,894,318 | 4/1999 | Endo | 347/262 |
| 5,957,050 | 9/1999 | Scheffer et al. | 101/227 |

FOREIGN PATENT DOCUMENTS

| | | |
|---|---|---|
| 0 884 258 A2 | 12/1998 | European Pat. Off. . |
| 55-31796 | 3/1980 | Japan . |
| 59-108646 | 6/1984 | Japan . |
| 60-118542 | 6/1985 | Japan . |
| 63-37657 | 3/1988 | Japan . |
| 1-169564 | 11/1989 | Japan . |
| 4-089744 | 3/1992 | Japan . |
| 4-89744 | 3/1992 | Japan . |
| 6-71961 | 3/1994 | Japan . |
| 6-289673 | 10/1994 | Japan . |
| 8-002747 | 1/1996 | Japan . |
| 9-118016 | 7/1997 | Japan . |
| 9-188016 | 7/1997 | Japan . |

*Primary Examiner*—John S. Hilten
*Assistant Examiner*—Daniel J. Colilla
*Attorney, Agent, or Firm*—Armstrong, Westerman, Hattori, McLeland & Naughton

[57] ABSTRACT

A sheet supply apparatus adapted for use with a recording apparatus such as a printer. The sheet supply apparatus comprises a frame having a sheet conveying surface, a shaft rotatably arranged above the sheet conveying surface, and a plurality of protrusions arranged on the shaft in the axially spaced relationship and at circumferentially different angles. The sheet is conveyed toward a horizontal member (such as conveying rollers in a printer) extending in the direction perpendicular to the sheet conveying direction along the sheet conveying surface by the protrusions so as to cause the sheet to abut against the transverse member. Oblique feeding of a sheet is thus corrected.

18 Claims, 15 Drawing Sheets

SHEET SUPPLY APPARATUS WITH FEED PROTRUSIONS FOR SKEW CORRECTION

BACKGROUND OF THE INVENTION

1. Field of the Invention

The present invention relates to a sheet supply apparatus capable of supplying sheets while automatically correcting an oblique feeding thereof and a recording apparatus such as a printer using the sheet supply apparatus.

2. Description of the Related Art

A printer includes a printing head supported on a carriage and a platen opposed to the printing head. A sheet is conveyed between the printing head and the platen by a pair of sheet conveying rollers, and printed by the printing head. The sheet can be supplied toward the sheet conveying rollers automatically or manually. The sheet conveying rollers are normally stationary, and when a sheet is supplied to the vicinity of the sheet conveying rollers, begins to rotate based on the output of a sensor.

Especially, when a sheet is supplied manually toward the sheet conveying rollers, the problem of oblique feeding of the sheet occurs. The oblique feeding is a phenomenon in which the upper end of the sheet (the leading side of the sheet in the direction of conveyance) is supplied in a diagonal direction to the sheet conveying rollers. When the sheet is supplied to the sheet conveying rollers obliquely, the sheet conveying rollers convey the sheet in oblique position to the printing head, so that the sheet fails to be printed accurately. When the sheet is positioned obliquely when supplied, therefore, the obliqueness of the sheet is desirably corrected.

JP-A-59-108646 discloses an oblique feeding correction apparatus comprising an oblique feeding roller for moving the sheet diagonally to the direction of the sheet conveyance and a side guide. The side guide is arranged on the side end of the sheet conveying path, and the oblique feeding roller causes the sheet to come into contact with the side guide. Thus the sheet proceeds along the side guide so that the oblique feeding thereof is corrected. Further, according to this patent publication, an anti-flexibility member is arranged above the oblique feeding roller and holds the sheet in conveyance from above thereby to prevent the sheet conveyed from being distorted.

JP-A-55-31796 discloses an oblique feeding correction apparatus having two paddle wheels on a shaft. Each paddle wheel has three blades arranged at equal angular intervals and each blade is twisted. The twisted blades move the sheet in a diagonal direction and press it against the side wall of a container. The oblique feeding of the sheet is thus corrected.

JP-A-60-118542 discloses an oblique feeding correction apparatus comprising a common driving roller mounted on a driving shaft and a plurality of driven rollers mounted on two driven shafts arranged on a straight line. The driven shafts are located above the driving shaft and movable in the vertical direction. The driven rollers are pressed against the drive rollers by the weight of the driven shafts and the driven rollers and are thus driven by the driving rollers.

The sheet is held by the driving rollers and the driven rollers and conveyed toward the sheet conveying rollers located ahead. When the sheet is fed obliquely, an upper side end of the sheet (the left side end of the sheet leading in the direction of conveyance, for example) comes into contact with the stationary sheet conveying rollers. Once an end of the sheet comes into contact with the sheet conveying rollers, the sheet slips on the driving roller and the driven rollers in contact (the left end side), so that the sheet continues to be conveyed by the driving roller and the driven rollers on the opposite side (on the right end side). As a result, an end of the sheet stops and the other end thereof is conveyed. Thus, the sheet is rotated about the end thereof in contact with the sheet conveying rollers thereby to correct the oblique feeding of the sheet.

In the conventional oblique feeding correction apparatus in which the oblique feeding of the sheet is corrected by moving the sheet obliquely by a diagonal roller or a twisted blade and bringing it into contact with the side wall of a side guide or a container, even after the sheet comes into contact with the side wall of the side guide or the container and the oblique feeding thereof is corrected, the sheet is subjected to the force from the oblique direction and its movement fluctuates in the direction of conveyance. Thus, the oblique feeding of the sheet fails to be corrected completely.

In the case where driven rollers are arranged on two aligned driven shafts and the sheet slips on the driven roller of one driven shaft while the sheet continues to be moved by the driven roller of the other driven shaft thereby to correct the oblique feeding of the sheet, on the other hand, the sheet slip cannot be controlled as intended. Specifically, the driven roller of one driven shaft and the driven roller of the other driven shaft are configured in the same manner. It is therefore impossible that the sheet slips on the driven roller of one driven shaft and fails to slip on the driven roller of the other driven shaft. Also, in the case where the sheet is conveyed nipped between a driving roller and a driven roller, on the other hand, the sheet is conveyed while being kept nipped between the driving roller and the driven roller and therefore the turning effort for correcting the oblique feeding described above is not generated.

Also, an attempt to forcibly correct the oblique feeding of the sheet exerts an unreasonable force on the sheet and may deform or damage the sheet.

SUMMARY OF THE INVENTION

The object of the present invention is to provide a sheet supply apparatus having a comparatively simple structure and being capable of securely correcting the oblique feeding of the sheet and a recording apparatus using such a sheet supply apparatus.

A sheet supply apparatus according to this invention comprises a frame having a sheet conveying surface and defining a sheet conveying direction, a shaft rotatably arranged above the sheet conveying surface, a plurality of protrusions formed on the shaft in the axially spaced relationship and with respect to the shaft at circumferentially different angles, and a rotating device for rotating the shaft, whereby oblique feeding of a sheet is corrected by conveying the sheet by the protrusions toward a transverse member extending perpendicular to the sheet conveying direction along the sheet conveying surface so as to cause the sheet against the transverse member.

In this arrangement, the transverse member extending perpendicular to sheet conveying the direction of along the sheet conveying surface can be a member arranged in the recording apparatus which uses the sheet supply apparatus. In the case where the sheet supply apparatus is a printer, for example, the transverse member is a pair of sheet conveying rollers of the printer. Therefore, the existing sheet conveying rollers can be used as the transverse member, and the provision of only one shaft is sufficient. Thus, an inexpensive sheet supply apparatus can be provided which has a small number of parts.

The rotatable shaft having a plurality of the protrusions conveys the sheet toward the transverse member (sheet conveying rollers). Specifically, the sheet is conveyed only by the friction force of the protrusions mounted to the shaft. A plurality of the protrusions are arranged at intervals along the axial direction of the shaft and at circumferentially different angles. At one moment, therefore, one protrusion comes into contact with the sheet, and the sheet is conveyed by the particular protrusion. In this way, a plurality of the protrusions successively come into contact with the sheet, so that the sheet is conveyed toward the horizontal member (sheet conveying rollers).

In the case where the sheet is fed obliquely, an upper side end of the sheet (the left side of the leading end of the sheet in the conveying direction, for example) abuts against the stationary transverse member (sheet conveying rollers). When the end of the sheet comes into contact with the transverse member (sheet conveying rollers), that end of the sheet stops while the other part of the sheet continues to be conveyed by the protrusions of the shaft. Thus the sheet is rotated about the stationary end thereof and the oblique feeding of the sheet is corrected. In this case, only one protrusion engages with the sheet to convey and rotate the sheet and does not restrict the sheet as a pair of pinch rollers would. The sheet thus is easily and securely rotated thereby to correct the oblique feeding of the sheet.

Preferably, the apparatus comprises configured rollers each having a hub held by the shaft and at least one lobe portion protruding from the hub, wherein each of the protrusions is formed as the lobe portion. In this case, preferably, at least one lobe portion comprises two lobe portions extending in the diametrically opposite directions of the shaft. Further, the shaft has an angular range where none of the lobe portions is in contact with the sheet moving along the sheet conveying surface.

Preferably, the sheet conveying surface has depressions corresponding to the positions of the protrusions. The forward end of each protrusion enters a corresponding depression, so that the sheet supplied on the sheet conveying surface is conveyed by the protrusions while being pressed and deformed slightly in the depressions. The amount of friction of the sheet with the protrusions varies with the thickness of the sheet. When a single thin sheet is conveyed, for example, the sheet is liable to be deformed in the depressions and conveyed with a weak feeding force while being in light contact with the protrusions. When a thick single sheet or a slip or the like including a plurality of sheets is conveyed, on the other hand, the sheet is not easily deformed in the depressions, so that the sheet is conveyed with a strong feeding force while strongly contacting the protrusions. In the prior art, in the case where the feeding force is required to be changed between thin and thick paper, a mechanism such as a torsion spring is used for changing the feeding force according to the paper thickness. Such an apparatus, however, has resulted in an increased cost due to an increased number of required parts.

Preferably, the sheet conveying surface has at least one pad for braking the sheet when ejected. Also, a sheet sensor is arranged in the vicinity of the shaft. Further, a phase sensor is included for detecting the rotational position of the shaft.

A recording apparatus according to this invention comprises a casing, a movable carriage, a printing head mounted to the carriage, a platen opposed to the printing head, a pair of sheet conveying rollers arranged on one side of the platen and a sheet supply apparatus capable of supplying the sheet toward the sheet conveying rollers. The sheet supply apparatus comprises a frame mounted to the casing and having a sheet conveying surface and defining a sheet conveying direction, a shaft rotatably arranged above the sheet conveying surface, a plurality of protrusions formed on the shaft in the axially spaced relationship and at circumferentially different angles with respect to the shaft, and a rotating device for rotating the shaft, whereby oblique feeding of the sheet is corrected by conveying the sheet by the protrusions toward said pair of the sheet conveying rollers along the sheet conveying surface so as to cause the sheet to abut against said pair of the sheet conveying rollers.

This recording apparatus has a feature similar to the sheet supply apparatus described above.

Preferably, the casing has mounting means for mounting the frame of the sheet supply apparatus removably.

Preferably, the apparatus includes a first sheet sensor arranged in the vicinity of the shaft, a second sheet sensor arranged in the vicinity of a pair of the sheet conveying rollers, and a third phase sensor for detecting the rotational position of the shaft.

In this case, when the first sheet sensor detects the sheet in the sheet supply apparatus, the shaft is rotated in accordance with the output of the first sheet sensor and the sheet is conveyed toward a pair of the sheet conveying rollers by the protrusions.

Further, the sheet, after hitting a pair of the sheet conveying rollers, is conveyed by a predetermined amount by the protrusions and a pair of the sheet conveying rollers, after which the sheet is further conveyed only by a pair of the sheet conveying rollers.

Further, the apparatus comprises a pair of fourth sheet sensors located in the vicinity of the printing head for detecting the oblique feeding according to the difference in the number of detection steps by a pair of the fourth sheet sensors.

Further, when the oblique feeding is detected, the sheet involved is ejected to the sheet supply apparatus and the sheet is resupplied by the sheet supply apparatus.

Preferably, each of the protrusions is formed as a lobe portion of a configured roller having a hub held on the shaft and two lobe portions extending in the diametrically opposite directions of the shaft from the hub. The shaft has an angular range in which none of the protrusions is in contact with the sheet moving along the sheet conveying surface, and upon complete supply and eject of the sheet, the shaft is set in phase at a position in the angular range based on the output of the third phase sensor.

Preferably, the apparatus further comprises a pair of second sheet conveying rollers arranged on the other side of the platen, and a pair of the first sheet rollers are driven in the same direction at the same rotational speed as a pair of the second sheet conveying rollers.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Embodiments of the present invention will now be described below with reference to the drawings. In this case, a sheet is assumed to include a thin or thick single sheet of paper, a bundle of sheets of paper such as a slip sheet and a passbook.

Figure 1:
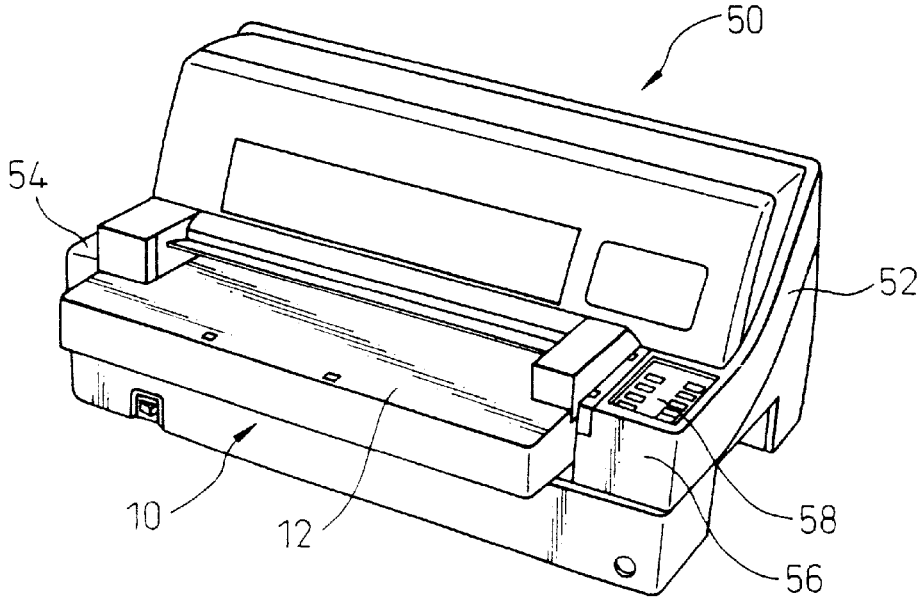
FIG. 1 is a perspective view showing a printer having a sheet supply apparatus according to the embodiment of the present invention.
Figure 2:
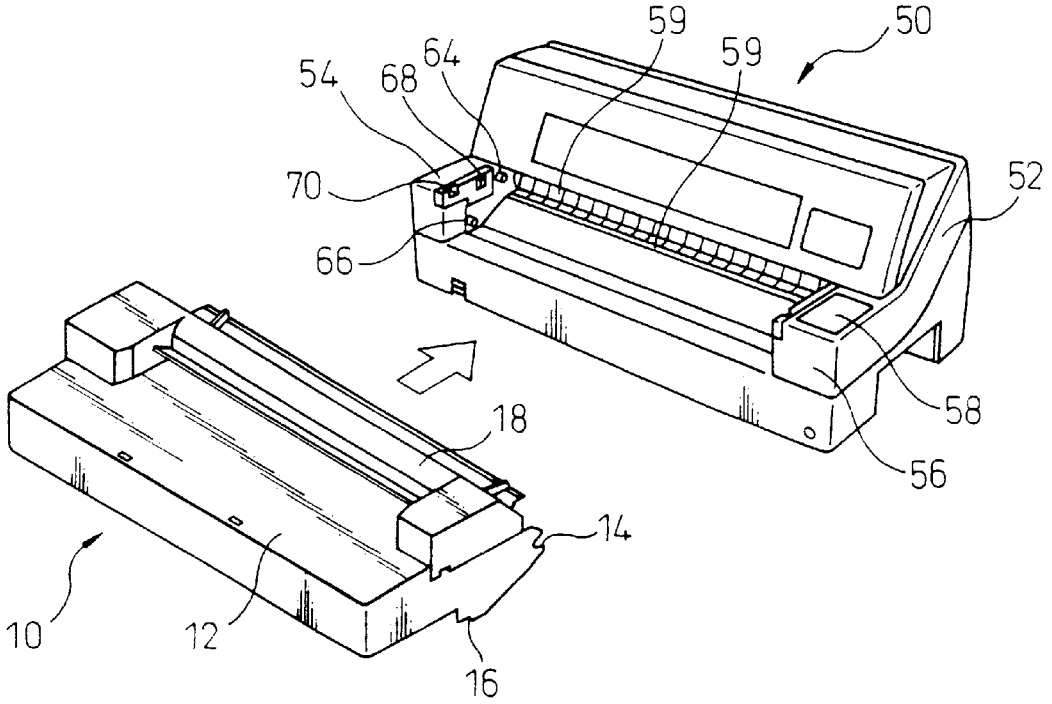
FIG. 2 is a perspective view showing the sheet supply apparatus being mounted on the printer.

FIG. 1 shows a printer (recording apparatus) 50 having a sheet supply apparatus 10. FIG. 2 shows the sheet supply apparatus 10 being mounted to the printer 50. The printer 50 includes a casing 52 having front side walls 54 and 56. The sheet supply apparatus 10 is adapted to be mounted between the front side walls 54 and 56 of the casing 52. An operation panel 58 is provided on the front side wall 56 of the casing 52. Further, the casing 52 has a paper guide 59, and a pair of sheet conveying rollers 60 and 62 (FIG. 6) are arranged in the casing 52. One of the sheet conveying rollers 60 and 62 is a drive roller, and the other is a driven roller rotated in contact with the drive roller.

In FIG. 2, the front side walls 54 and 56 of the casing 52 have on the inner surface thereof studs 64 and 66 as attaching means for the sheet supply apparatus 10. Also, recesses (grooves) 68 and 70 are formed in the inner surface of the front side walls 54, 56 of the casing 52 for mounting a table 88 described later. On the other hand, the sheet supply apparatus 10 comprises a frame 12 having mounting recesses 14 and 16 at the forward end and bottom of the side walls.

Figure 3A:
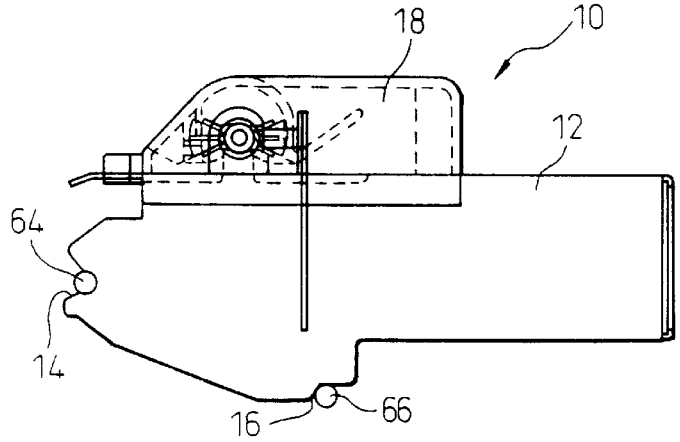
FIGS. 3A to 3C are views showing the sheet supply apparatus being demounted from the printer.
Figure 3B:
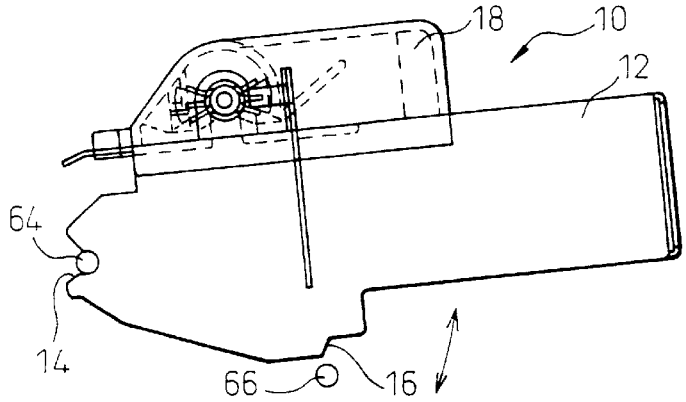
Figure 3C:
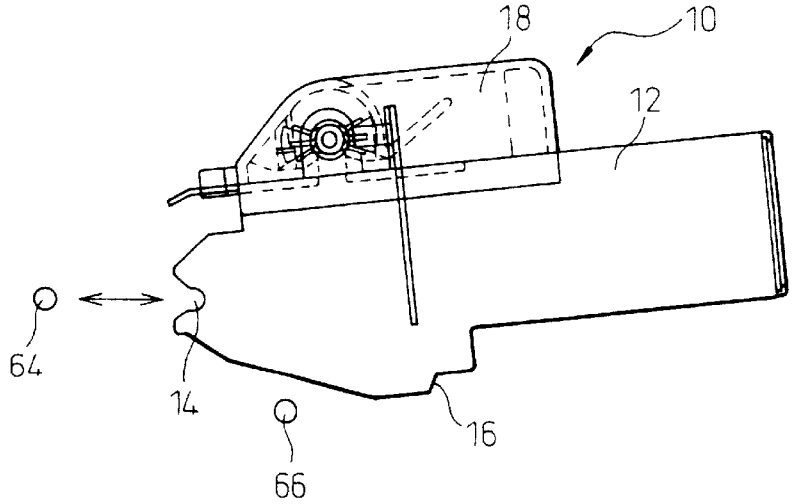

FIGS. 3A to 3C show the sheet supply apparatus 10 being demounted from the printer 50. As shown in FIG. 3A, the stud 64 is fitted in the mounting recess 14, and the stud 66 is fitted in the mounting recess 16, whereby the sheet supply apparatus 10 is mounted to the printer 50. For the sheet supply apparatus 10 to be demounted from this state, as shown in FIG. 3B, the front end of the sheet supply apparatus 10 is moved up, using the stud 64 as a supporting point (fulcrum) so that the stud 66 leaves the mounting recess 16. Then, as shown in FIG. 3C, the sheet supply apparatus 10 is pulled out forward, and the stud 64 leaves the mounting recess 14. The sheet supply apparatus 10 can also be mounted to the printer 50 in the reverse operation according to the steps of FIG. 3C to FIG. 3A. As a result, the sheet supply apparatus 10 can be removably mounted to the printer 50.

Figure 4:
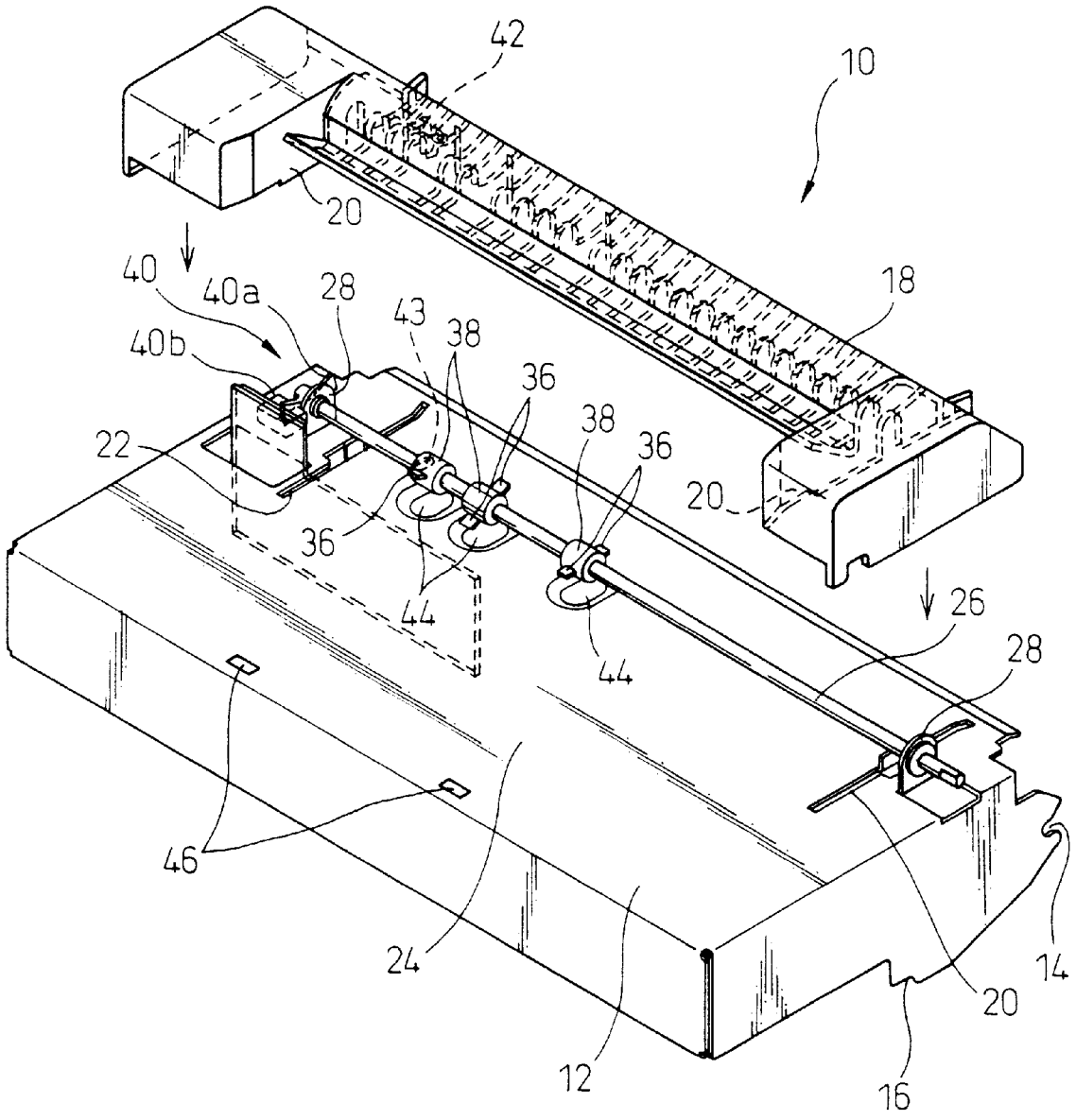
FIG. 4 is an exploded perspective view showing the sheet supply apparatus in detail.

FIG. 4 shows the sheet supply apparatus 10 in detail. The sheet supply apparatus 10 comprises a frame 12 and a cover 18 for covering the forward end portion of the frame 12. The lower ends of the vertical walls 20 of the cover 18 can be fitted in slits 22 of the frame 12, whereby the cover 18 can be mounted to the frame 12. The upper wall of the frame 12 is substantially flat and forms a sheet conveying surface 24.

Figure 9:
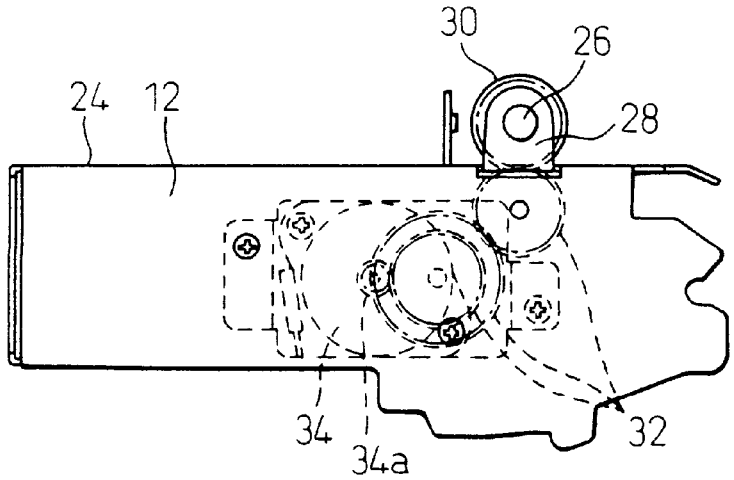
FIG. 9 is a view showing the rotating device for the supply shaft of the sheet supply apparatus.

A supply shaft 26 is rotatably arranged above the sheet conveying surface 24, and is supported on the frame 12 by vertical supports 28 having bearings. As shown in FIG. 9, a gear 30 is arranged on the end of the supply shaft 26. The gear 30 is connected to a motor gear 34*a* of a supply motor 34 through a gear train 32 arranged under the sheet conveying surface 24. The supply motor 34 is supported in the frame 12. The supply shaft 26 can thus be rotated by the supply motor 34.

As shown in FIG. 4, a plurality of protrusions 36 are arranged on the supply shaft 26 in the axially spaced relationship and at circumferentially different angles (or different phases) with respect to the supply shaft 26. The protrusions 36 are formed as lobe portions of configured rollers 38 each having a hub held on the supply shaft 26 and at least one lobe portion protruding from the hub. In this embodiment, three configured rollers 38 are arranged on the supply shaft 26, and in each of the configured rollers 38, two lobe portions extend in the diametrically opposed relationship of the shaft.

Figure 7:
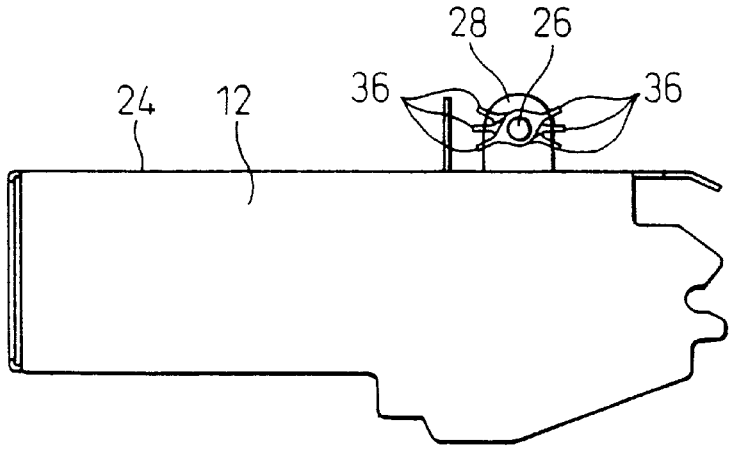
FIG. 7 is a side view showing the frame of the sheet supply apparatus from the lateral side thereof for showing the protrusions arranged on the supply shaft.

FIG. 7 is a side view of the frame 12, viewed in the lateral direction, for illustrating the protrusions 36 mounted on the supply shaft 26. Three sets of protrusions 36 diametrically opposed of the supply shaft 26 are arranged in the angular range of about 50 degrees, and no protrusions 36 are included in the angular range of 130 degrees which is the complementary angle to 50 degrees. In FIG. 7, none of the protrusions 36 contacts the sheet moving along the sheet conveying surface 24. Under this condition, the sheet is not subjected to the conveying force. The supply shaft 26 has an angular range in which none of the protrusions 36 comes in contact with the sheet moving along the sheet conveying surface 24.

In FIG. 4, a phase sensor 40 is arranged at the end of the supply shaft 26 far from the end thereof where the gear 30 is mounted.

Figure 8:
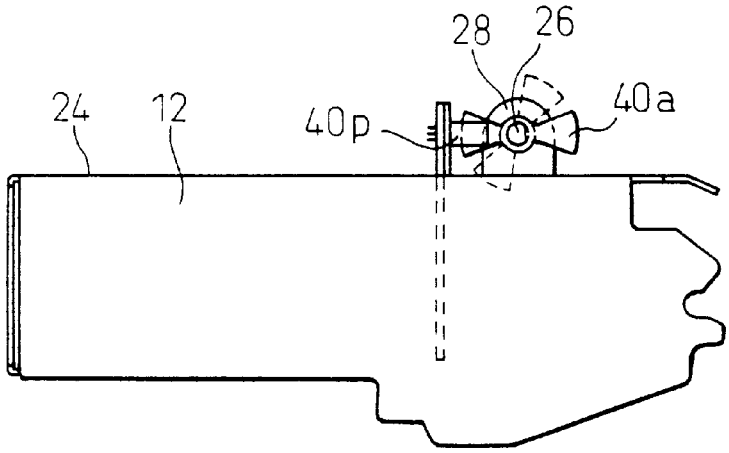
FIG. 8 is a side view showing the frame of the sheet supply apparatus from the lateral side thereof for showing the phase sensor.

FIG. 8 is a side view of the frame 12, viewed in the lateral direction for illustrating phase sensor 40. The phase sensor 40 includes a sector-shaped double-headed sensor lever 40*a* mounted on the supply shaft 26 and an optical detector $\mathbf{40}_p$ fixed to the frame 12. The optical detector $\mathbf{40}_p$ includes a light emitting section and a light receiving section, and the light path is cut off and a signal is generated by the optical detector $\mathbf{40}_p$, each time the sensor lever 40*a* passes between the light emitting section and the light receiving section.

Figure 6:
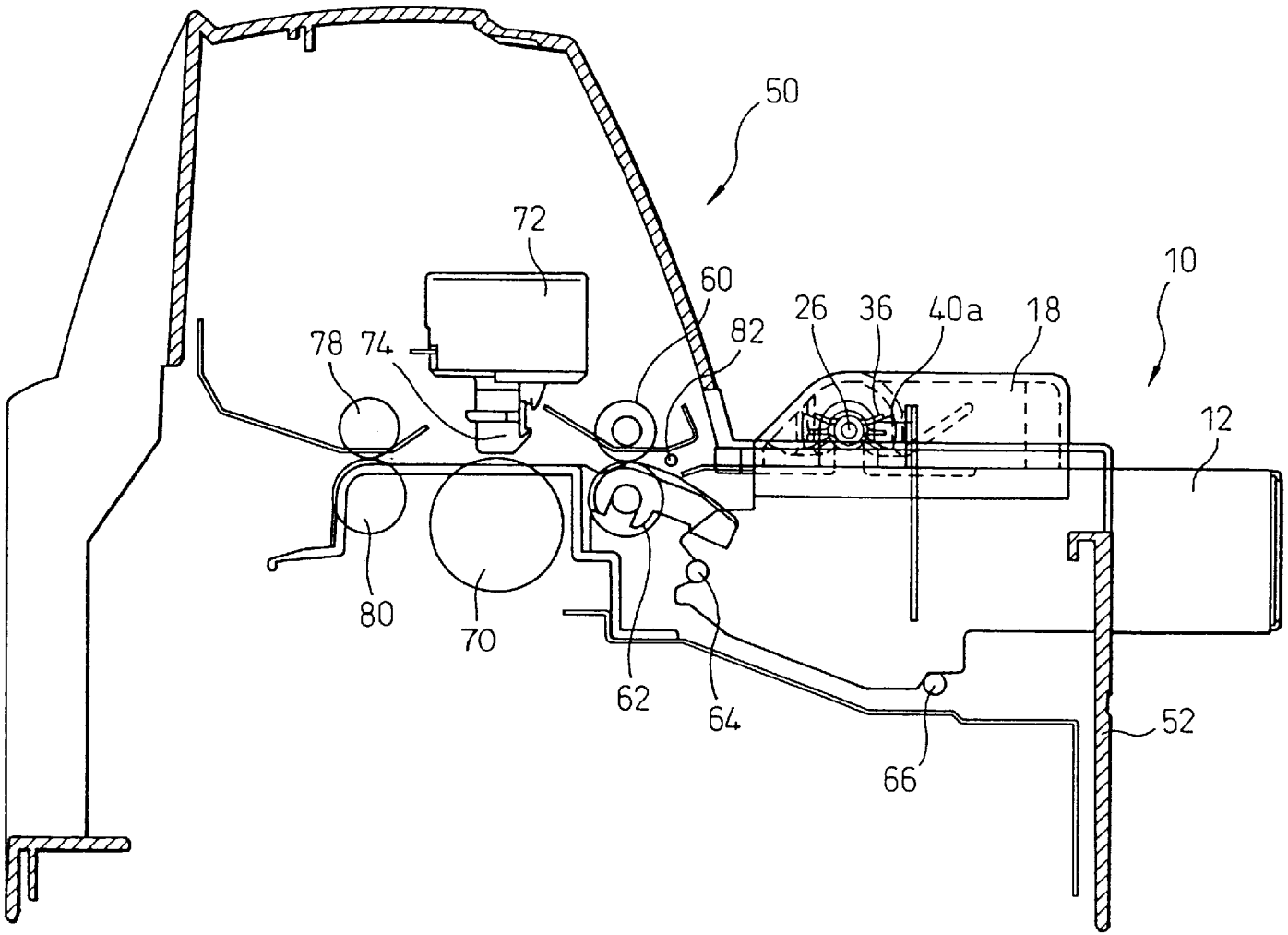
FIG. 6 is a cross-sectional view showing the printer on which the sheet supply apparatus is mounted.

In FIGS. 7 and 8, the protrusions 36 and the phase sensor 40 are shown separately from each other, but the protrusions 36 and the phase sensor 40 can be viewed at the same time, when the frame 12 is actually viewed laterally, as shown in FIG. 6. The protrusions 36 and the sensor lever 40*a* of the phase sensor 40 are mounted to the supply shaft 26 at almost the same angular phase.

Further, the sheet supply apparatus 10 comprises a sheet sensor (hereinafter referred to as the supply sheet sensor) 42 arranged in the vicinity of the supply shaft 26. The sheet sensor 42 is a reflection-type sensor including a light emitting section and a light receiving section, and is mounted to the cover 18, as shown in FIG. 4. A hole 43 is formed in the portion of the frame 12 under the sheet sensor 42. In the absence of a sheet, the light receiving section fails to react due to the presence of the hole 43 of the frame 12. In the presence of a sheet, on the other hand, the emitted light is reflected by the sheet and the light receiving section reacts to it.

Figure 10:
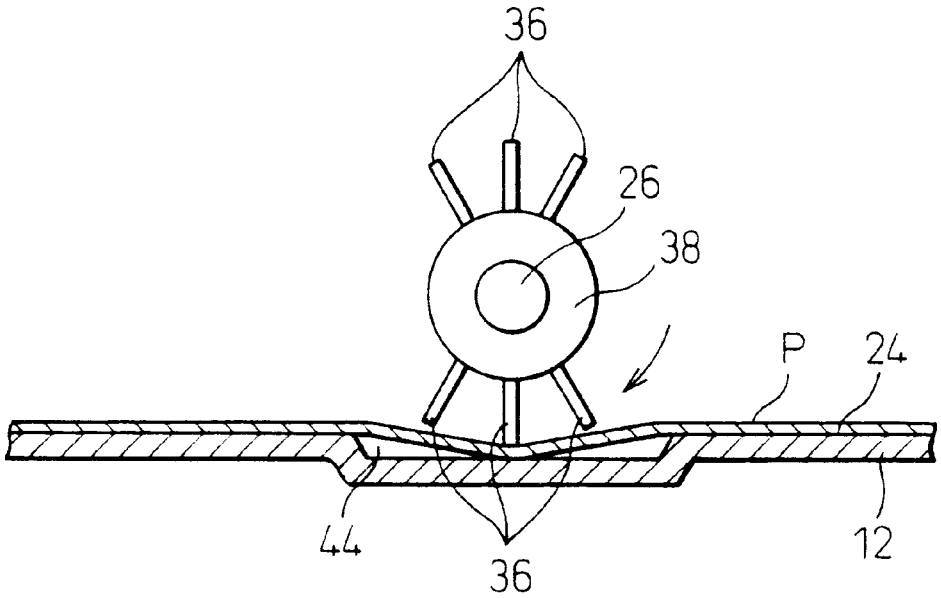
FIG. 10 is a cross-sectional view showing the sheet conveying path and the supply shaft having a plurality of protrusions.

Further, the sheet conveying surface 24 has depressions 44 at positions corresponding to the protrusions 36. As shown in FIG. 10, the forward end of each protrusion 36 enters the corresponding depression 44, and the sheet P supplied on the sheet conveying surface 24 is conveyed by the protrusions 3 while the sheet is pressed and slightly deformed in the depressions 44. The amount of friction of the protrusions 36 against the sheet P varies with the thickness of the sheet P. When the sheet P conveyed is a single thin sheet, for example, it is liable to be easily deformed in the depressions 44 and is conveyed with a weak feeding force while slightly contacting the protrusions 36. In the case where a thick single sheet or a slip including a plurality of sheets is conveyed, on the other hand, the sheet P is not easily deformed in the depressions 44, and is conveyed under a strong feeding force generated by a strong contact with the protrusions 36. In the prior art, in the case where the feeding force is required to be changed between a thin sheet and a thick sheet, a mechanism including a torsion spring or the like for changing the feeding pressure in accordance with the paper thickness is provided, leading to an increased number of parts and an increased cost.

Further, the sheet conveying surface 24 has pads 46 of rubber or the like having a large friction coefficient for braking the sheet when it is ejected. As a result, the sheet being ejected is prevented from falling off from the end of the frame 12.

Figure 5:
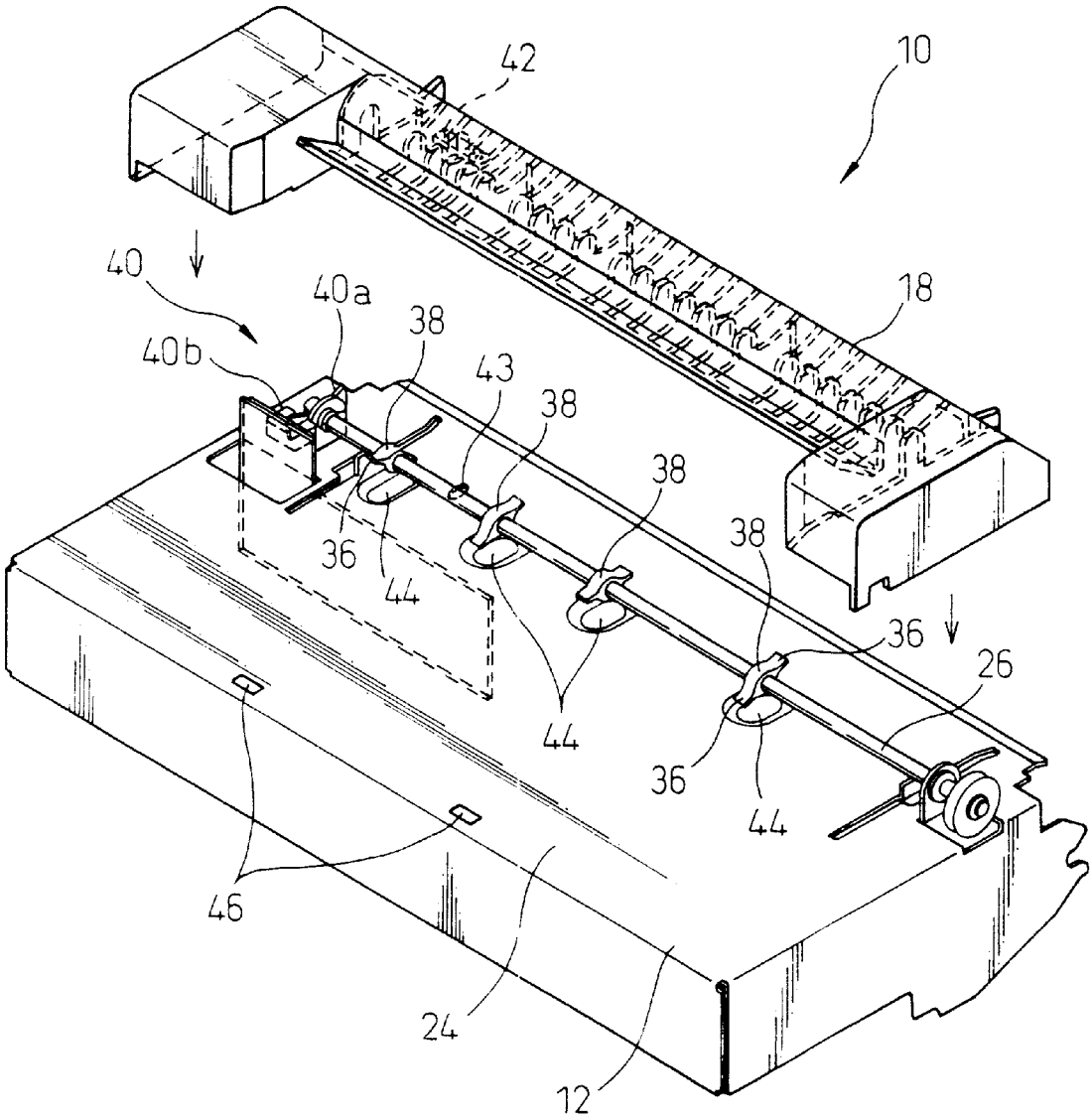
FIG. 5 is a view showing a modification of the sheet supply apparatus.

FIG. 5 is a perspective view showing a modification of the sheet supply apparatus 10. In this example, four configured rollers 38 including protrusions 36 are mounted to the supply shaft 26. The other points are similar to those of the sheet supply apparatus 10 of FIG. 4.

FIG. 6 is a cross-sectional view showing the printer 50 with the sheet supply apparatus 10 mounted thereto. The printer 50 includes a movable carriage 72, a printing head 74 mounted to the carriage 72, a platen 70 opposed to the printing head 74, and a pair of sheet conveying rollers 60 and 62 arranged on one side of the platen 70. Further, the printer 50 includes the sheet supply apparatus 10 described above.

Also, a pair of second sheet conveying rollers 78 and 80 are arranged on the opposite side of the platen 70. A pair of the first sheet conveying rollers 60 and 62 and a pair of the second sheet conveying rollers 78 and 80 are driven in the same direction at the same rotational speed. Therefore, the sheet supplied from the front sheet supply apparatus 10 and printed by the printing head 74 can be ejected to the sheet supply apparatus 10 or to a stacker (not shown) on the rear side.

Figure 11:
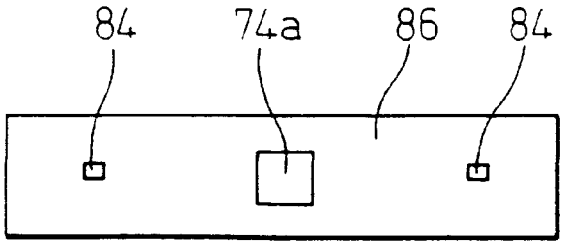
FIG. 11 is a view showing the printing head and two sheet upper end sensors.

Further, a sheet sensor (also called a conveying sheet sensor) 82 is arranged in the vicinity of a pair of the sheet conveying rollers 60 and 62, and a pair of the sheet sensors (called the sheet upper end sensors) 84 are arranged in the vicinity of the printing head 74. As shown in FIG. 11, sheet upper end sensors 84 are mounted together with the printing head 74 on a sheet guide 86 opposed to the platen 70. The sheet guide 86 has a central hole 74*a* for passing the printing pins of the printing head 74 therethrough, and a pair of the upper end sensors 84 are arranged on either side of the hole 74*a* at equidistant positions. The two sheet upper end sensors 84 and the hole 74*a* are arranged on a line perpendicular to the sheet conveying direction. The two sheet upper end sensors 84 can detect the arrival of the upper end (leading end) of the sheet at the position of the printing head 74 and oblique feeding of the arriving sheet.

Figure 12A:
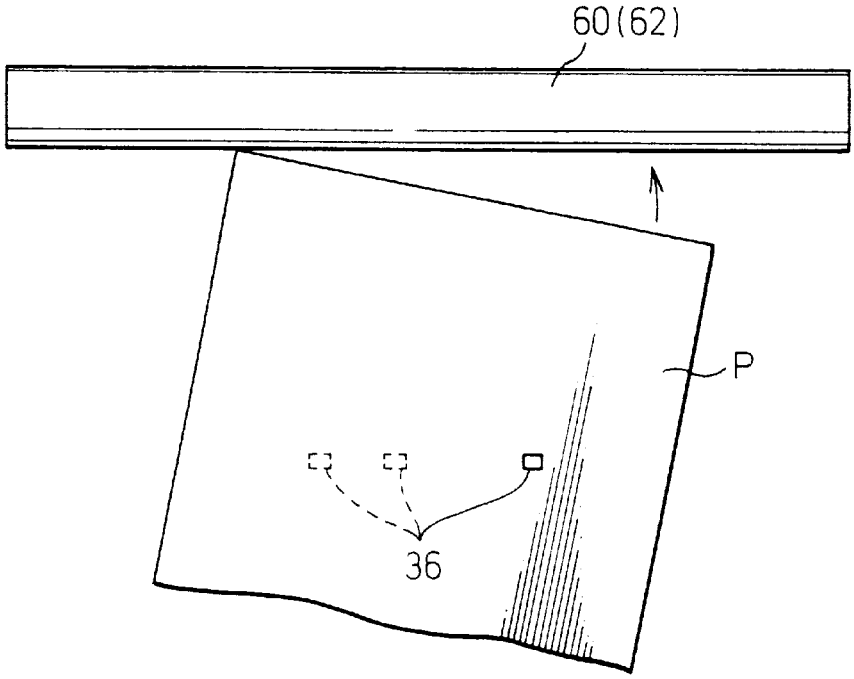
FIGS. 12A and 12B are views explaining the principle of correcting the oblique feeding of the sheet.
Figure 12B:
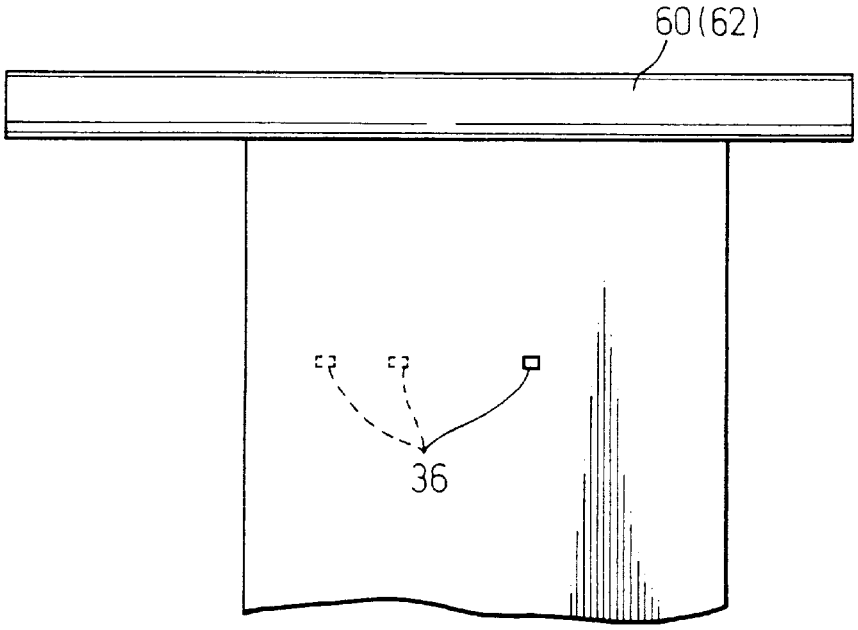

The operation of the sheet supply apparatus 10 will be now explained with reference to FIGS. 12A and 12B.

The rotatable supply shaft 26 having a plurality of protrusions 36 conveys the sheet P toward (the nip of) the sheet conveying rollers 60 and 62. In this case, the sheet P is conveyed only by the friction force of the protrusions 36 mounted to the supply shaft 26. Since the protrusion 36 are arranged at axial intervals along the supply shaft 26 and at circumferentially different angles, the sheet P is brought into contact with one protrusion 36 and conveyed by that protrusion 36 at one moment. A plurality of protrusions 36 contact the sheet P successively, so that the sheet P is conveyed toward the sheet conveying rollers 60 and 62.

In the case where the sheet P is fed obliquely, the upper, side end of the sheet P (the left side end of the leading edge of the sheet P in the direction of conveyance, for example) comes into contact with the stationary conveying rollers 60 and 62. When the end of the sheet P abuts against the sheet conveying rollers 60 and 62, that end of the sheet P stops while the other portion of the sheet continues to be conveyed by the protrusions 36 of the supply shaft 26, with the result that the sheet P is rotated about the stopped end thereof (FIG. 12A) and oblique feeding of the sheet P is corrected (FIG. 12B). In this case, only one protrusion 36 is substantially engaged with the sheet P for conveying and rotating the sheet P (This protrusion 36 is indicated by the solid line and the other protrusions 36 by the broken line). With the rotation of the supply shaft 26, however, the protrusion 36 which engages with the sheet P changes from one to another. Since each protrusion 36 engages with the sheet P at substantially one point of contact, the sheet P is easily and securely rotated to thereby correct oblique feeding. In the case where the sheet P is held and conveyed by a pair of pinch rollers, instead of the protrusion 36 shown by the solid line, the sheet P may be conveyed in the oblique position without being rotated as intended.

In this way, according to the present invention, oblique feeding of the sheet P can be corrected by conveying the sheet P toward the transverse member (sheet conveying rollers 60 and 62) extending perpendicular to the sheet conveying direction along the sheet conveying surface 24 by the protrusions 36 so as to cause the sheet P to abut against the transverse member (sheet conveying rollers 60 and 62). Also, it is possible to arrange a transverse member such as a shutter before the sheet conveying rollers, so that the transverse member is retracted after the oblique feeding of the sheet is corrected.

FIGS. 13 to 16 are flowcharts showing the manner, in which the operation of supplying the sheets is controlled according to the embodiment of FIGS. 1 to 12. This control operation is started by turning on the power switch on the operation panel 58 (S1). Step S2 judges whether a sheet exists in the sheet supply apparatus 10 or not. This judgement is made by the supply sheet sensor 42 which judges whether a sheet exists in the vicinity of the supply shaft 26. In the case where the judgement in step S2 is that a sheet exists, the process proceeds to step P in FIG. 15. In the case where the judgement in step S2 is that no sheet exists, on the other hand, the process proceeds to step S3 for matching the phase of the supply shaft 26. The phase matching of the supply shaft 26 is to rotate the supply shaft 26 to and stop at the neutral position in FIGS. 7 and 8 based on the output of the phase sensor 40. At the position of FIGS. 7 and 8, none of the protrusions 36 is in contact with the sheet on the sheet conveying path 24.

Step S4 judges whether or not the supply sheet sensor 42 is turned on. If the supply sheet sensor 42 is not turned on, the process waits until it is turned on. Once the supply sensor 42 is turned on, the process proceeds to step S5, where the supply motor 34 is rotated to thereby rotate the supply shaft 26. The supply motor 34 is a stepping motor, the rotation of which is controlled by the number of steps. In this way, the sheet is conveyed toward the sheet conveying rollers 60 and 62 by the protrusions 36 mounted to the supply shaft 26.

Step S6 judges whether the conveying sheet sensor 82 on the printer body is turned on or not. If the conveying sheet sensor 82 is not turned on, the process proceeds to step S7 for judging whether the number of steps of the supply motor 34 has reached a predetermined maximum value or not. Unless the conveying sheet sensor 82 is not turned on even when the number of steps has reached the maximum value, the process judges that a jam or the like has occurred and proceeds to step S8 for issuing an alarm such as a buzzer or a warning lamp. If the result of step S6 is affirmative, the process proceeds to FIG. 14.

Figure 14:
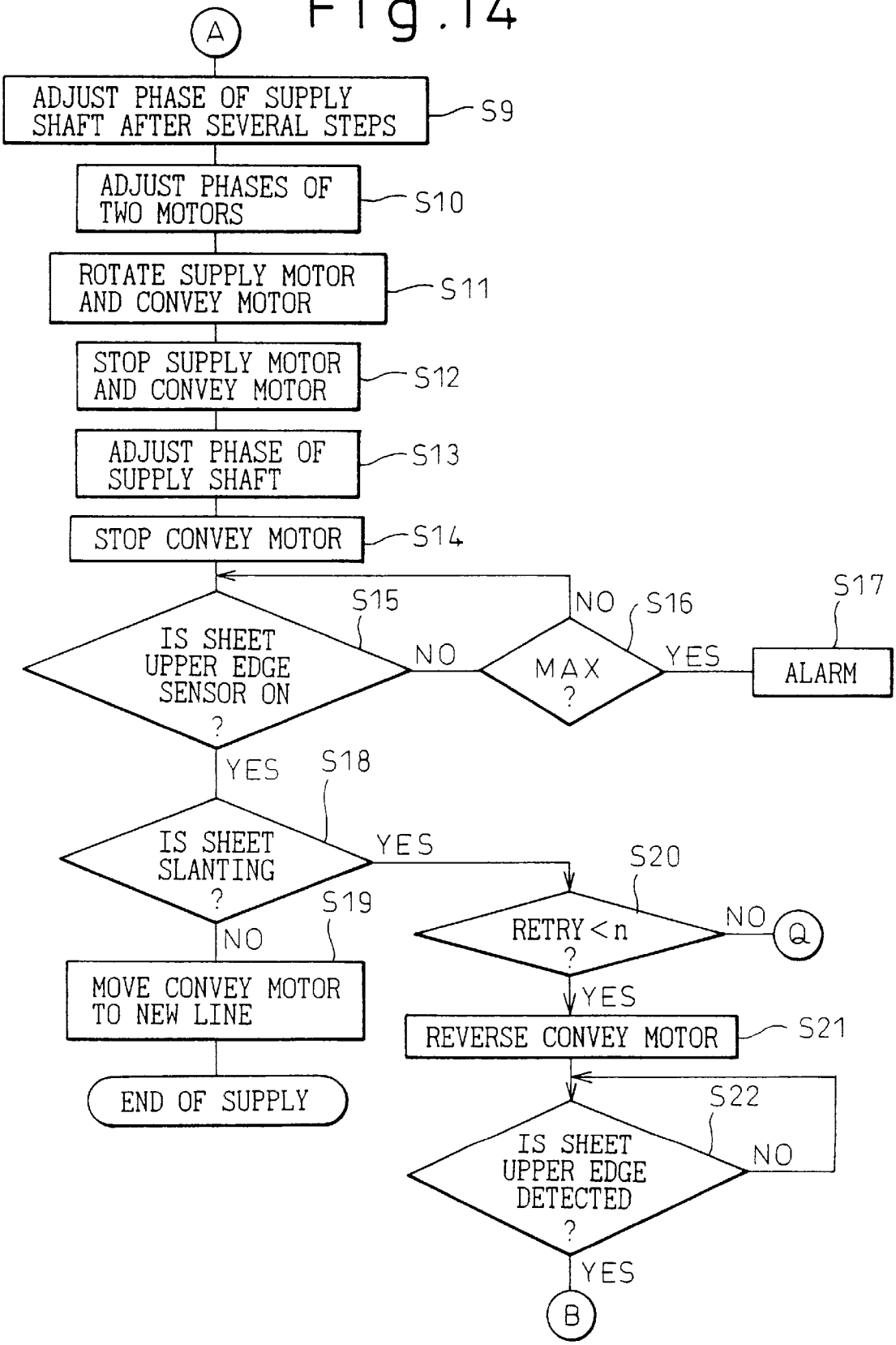
FIG. 14 is a flowchart showing the continuation of FIG. 13.

In step S9 in FIG. 14, after the conveying sheet sensor 82 on the printer body side is turned on and the supply motor 34 is rotated in several steps, the supply shaft 26 is set in phase. In this way, the sheet is conveyed further toward the sheet conveying rollers 60 and 62. While the sheet is brought into contact with the sheet conveying rollers 60 and 62, oblique feeding of the sheet is corrected as explained with reference to FIG. 12. After the sheet is brought into contact with the sheet conveying rollers 60 and 62, the supply shaft 26 is set in phase in the same manner as described above.

In step S10, the supply motor 34 and the conveying motor (the stepping motor (not shown) for driving the sheet conveying roller on the body side) are set in phase. In step S11, the supply motor 34 and the conveying motor are driven at the same time. Specifically, the sheet is positively fed to the nip of the sheet conveying rollers 60 and 62, and the upper end of the sheet is inserted and nipped by the nip. In step S12, the supply motor 34 and the conveying motor are stopped provisionally, and in step S13, the supply shaft 26 is set in phase in the same manner as described above. Specifically, in step S11, the two motors are driven at the same time and rotated by a predetermined number of steps, after which only the supply shaft 26 is stopped at a predetermined rotational angular position so that protrusions do not contact the sheet. In step S14, the sheet is conveyed only by the conveying motor.

Step S15 judges whether the sheet upper end sensors 84 have been turned on or not. If the judgement in step S15 is NO, the process proceeds to step S16. Step S16 judges whether the number of steps of the conveying motor that has started rotating has reached a predetermined maximum value or not. If the sheet upper end sensors 84 are not turned on even when the number of steps has reached the maximum value, it is judged that a jam or the like has occurred and the process proceeds to step S17 for issuing an alarm by a buzzer or a warning lamp.

In the case where the result of step S15 is affirmative, the process proceeds to step S18 for judging whether the sheet is fed obliquely, by a pair of the sheet upper end sensors 84. Specifically, the time point when one sheet upper end sensor 84 detects the upper end of the sheet is compared with time point when the other sheet upper end sensor 84 detects the upper end of the sheet, and if the difference between the two time points is included in a tolerable range, it is decided that the sheet is not obliquely fed. If the difference is not included in the tolerable range, on the other hand, it is decided that the sheet is obliquely fed. In the case where the result of step S18 is NO, the process proceeds to step S19 for rotating the supply motor a predetermined number of steps and performing the operation for a line feed. In this way, the sheet is completely supplied.

If the result of step S18 is affirmative, the process proceeds to step S20 for judging whether the number of retrys is smaller than a predetermined value "n" or not. The retry is to resupply (and correct the oblique feeding of) the sheet when it is judged that the sheet is fed obliquely. In the case where the judgement in step S20 is that the number of retries is larger than a predetermined number n, the process proceeds to step Q in FIG. 15.

If the result of step S20 is affirmative, the process proceeds to step S21 for rotating the conveying motor in the reverse direction and feeding the sheet backward toward the sheet supply apparatus 10. Then, step 22 judges whether the conveying sheet sensor 82 on the printer body side has detected the upper end of the sheet or not. In this case too, if a sheet jam is detected, an alarm is issued. If the result of step S22 is affirmative, it is judged that the forward end of the sheet has left the sheet conveying rollers 60 and 62 and the sheet has returned to the sheet supply apparatus 10. Then, the process proceeds to B in FIG. 13.

Figure 13:
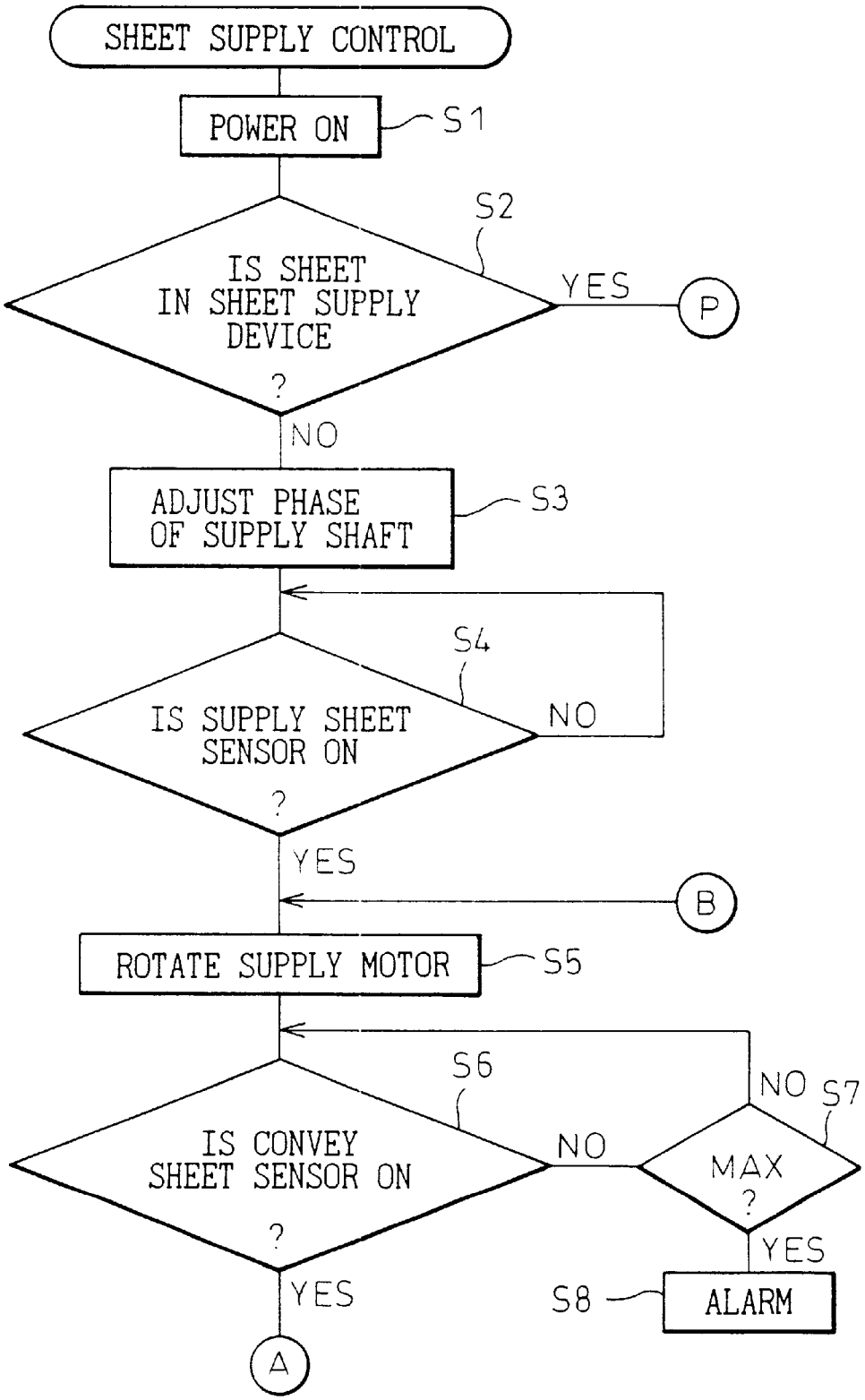
FIG. 13 is a flowchart for controlling the supply of the sheet according to the embodiment shown in FIGS. 1 to 12B.

In step S5 of FIG. 13, the supply motor 34 is rotated to rotate the supply shaft 26. The sheet is thus conveyed toward the sheet conveying rollers 60 and 62 by the protrusions 36 mounted to the supply shaft 26. If step S6 judges that the conveying sheet sensor 82 on the printer body side has turned on, the process proceeds to step S9 in FIG. 14, and further through steps S10 and S11 to S14, proceeds to step S15. In the meantime, the sheet is conveyed by the protrusions 36 of the supply shaft 26 to thereby correct the oblique feeding thereof.

Step S15 decides whether the sheet upper end sensors 84 have turned on or not, and step S18 judges whether or not the sheet is fed obliquely. If the oblique feeding of the sheet is corrected in steps S11 to S14, the result of step S18 is negative. Therefore, in step S19, the supply motor is rotated a predetermined number of steps for line feed operation for printing to thereby complete the sheet supply process. If the result of step S18 is affirmative, the process proceeds to perform a retry through steps S20 to S22 and steps S5 to S18.

Figure 15:
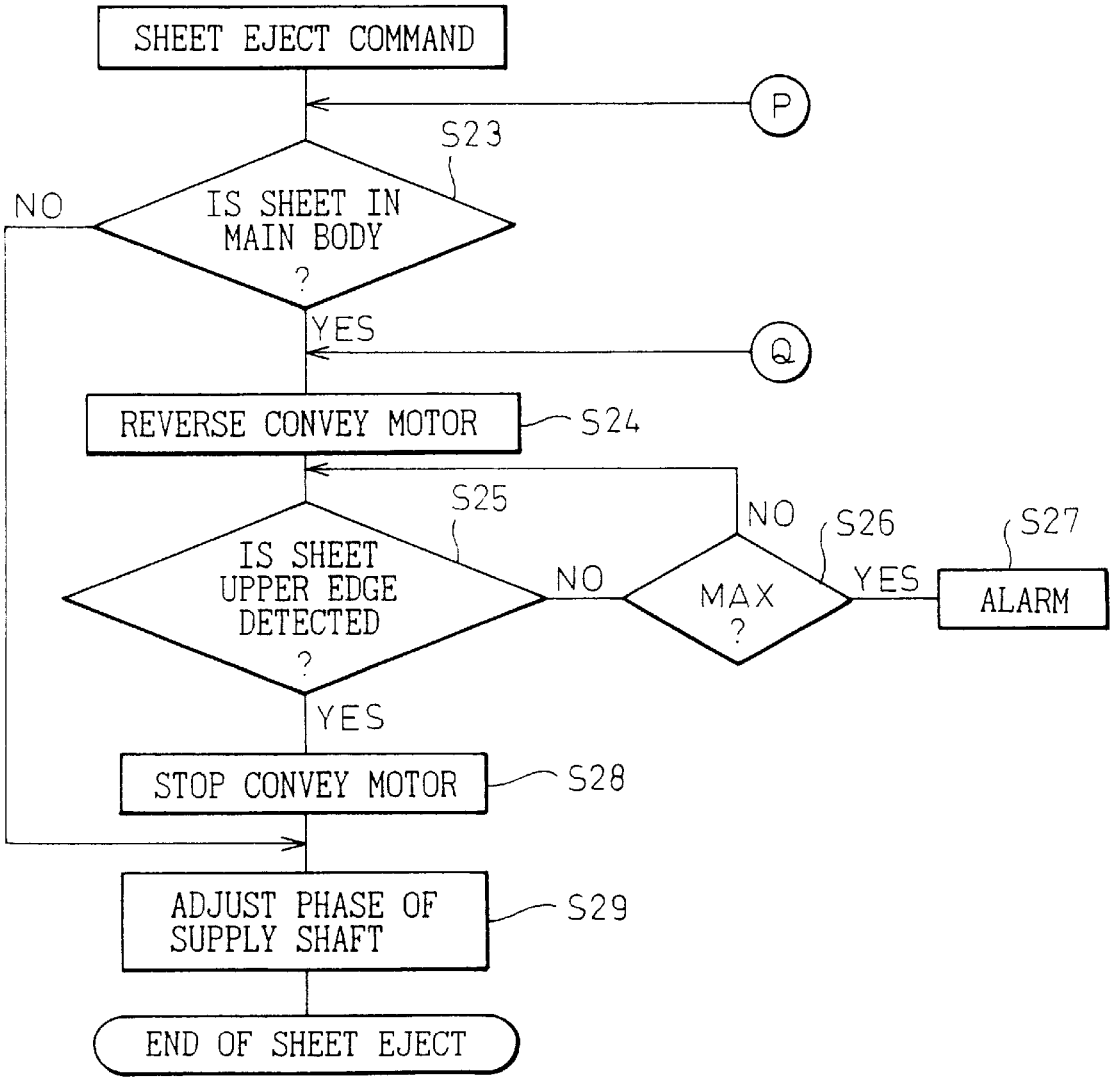
FIG. 15 is a flowchart showing the control of sheet EJECT.

FIG. 15 is a flowchart showing the control of the sheet eject operation. In response to a sheet eject command, or when step P is passed when the sheet is supplied, steps S23 judges whether a sheet exists on the printer body side from the output of the conveying sheet sensor 82 or not. If the result of step S23 is negative, the process proceeds to step S29 to set the supply shaft 26 in phase. The phase of the supply shaft 26 is set by making an almost half rotation of the supply shaft 26 and stopping the supply shaft 26 at a position where the protrusions 36 are not in contact with the sheet. Therefore, in the operation of step S29, the sheet that exists in the sheet supply apparatus 10 is kicked forward by the protrusions 36 and becomes easily recoverable. In this case, pads 46 having a large friction coefficient such as rubber are provided to prevent the sheet from proceeding excessively and falling off from the sheet conveying surface 24.

In the case where the result of step S23 is affirmative, the process proceeds to step S24 so that the sheet conveying motor is rotated in the reverse direction. Also, even in the case where the result of step 20 is negative, the process proceeds to step S24 for rotating the sheet conveying motor in the reverse direction. Then, step S25 detects whether or not the upper end of the sheet has left the sheet conveying rollers 60, 62 based on the output of the conveyed sheet sensor 82. If the result of step S25 is affirmative, the process proceeds to step S29 for setting the supply shaft 26 in phase. As a result, the protrusions 36 kick the sheet forward and the supply shaft 26 is stopped at a position where the protrusions 36 are not in contact with the sheet.

If the result of step S25 is negative, the process proceeds to step S26 for judging whether the number of steps of the sheet conveying motor is larger than a predetermined maximum value or not. If the result thereof is affirmative, it is judged that a jam of the sheet has occurred, and an alarm is issued in step S27. If the result of step S26 is negative, on the other hand, the judgement of step S25 is repeated.

Upon completion of supply and ejection of the sheet in the above-mentioned operation, the supply shaft 26 is always set in phase in order to prevent the sheet from being caught or to reduce the conveying load. Then, in the initial stage of supply in step S2, etc., for example, the supply shaft 26 should already be in phase. Even in such a case, the supply shaft 26 is set in phase to a state in which it is rotated 180 degrees. By the way, the phase setting of step S29 is of course accomplished by rotating the supply shaft 26 in a direction opposite to that for supply.

Figure 16:
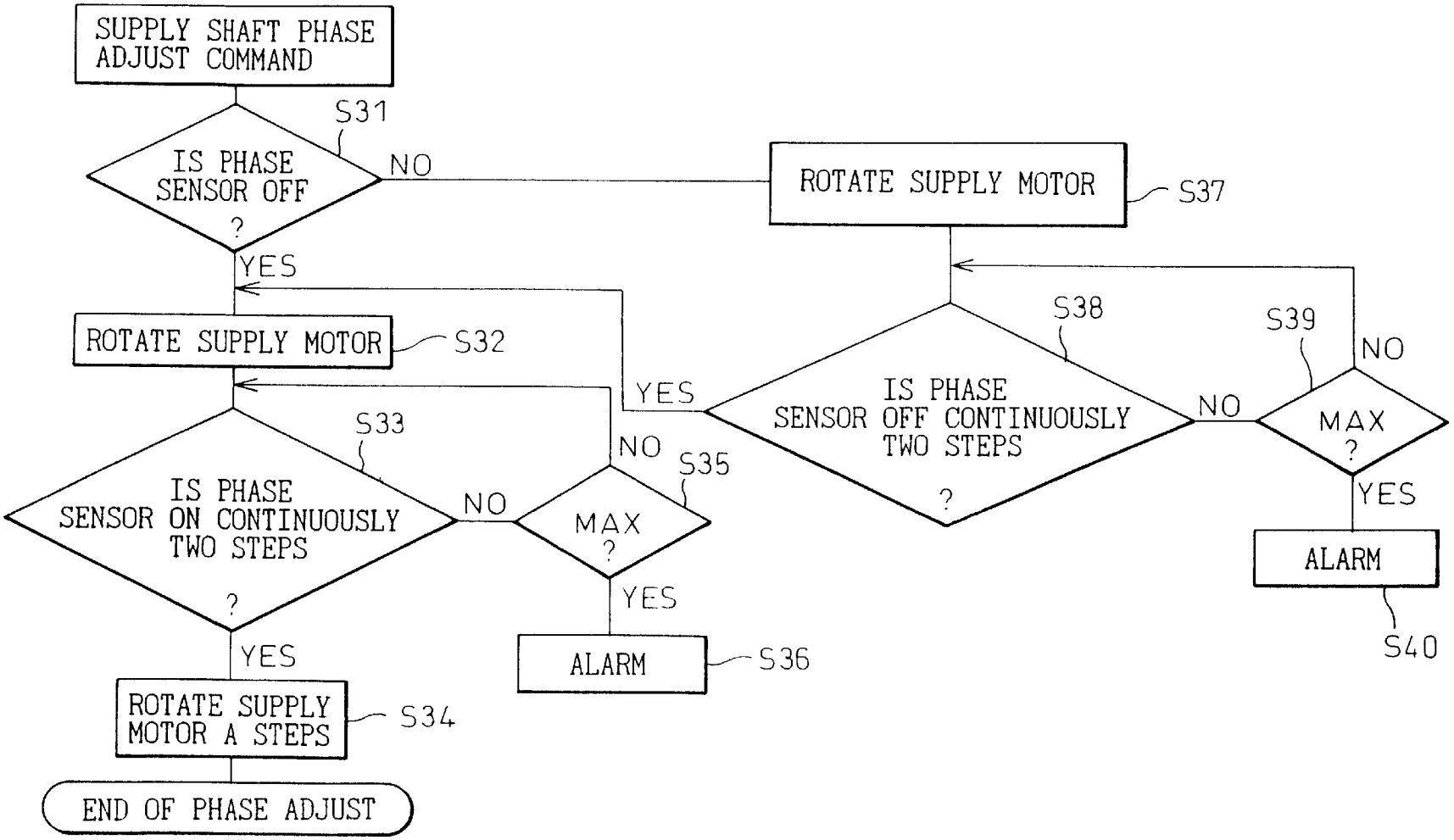
FIG. 16 is a flowchart showing the phase matching of the supply shaft.

FIG. 16 is a flowchart for phase setting of the supply shaft 26. Step S31 judges whether the phase sensor 40 is in the off-state or not. As explained with reference to FIG. 8, the phase sensor 40 includes the sector-shaped double-headed sensor lever 40*a* mounted to the supply shaft 26, and the optical detector 40*b*. In the case where the sensor lever 40*a* is not at a position where the light path of the optical detector 40*b* is cut off, the phase sensor 40 is in the off-state.

If the result of step S31 is affirmative, the supply motor 34 is rotated in step S32 to thereby rotate the supply shaft 26. Then, step S33 judges whether the phase sensor 40 turned on in two successive steps of the supply motor 34 or not. This is accomplished by detecting that the sensor lever 40*a* begins to cut off the light path of the optical detector 40*b*. If the result of step S33 is affirmative, the supply motor 34 is rotated a predetermined number a of steps so that the supply shaft 26 comes to be located at a neutral position shown in FIG. 8. In this way, the supply shaft 26 is held at a position where none of the protrusions 36 is in contact with the sheet. In this state, the decision of step S4 in FIG. 13 is made, for example.

If the result of step S31 is negative, the supply motor 34 is rotated to thereby rotate the supply shaft 26 in step S37. Then, step S38 judges whether the phase sensor 40 has turned off in two successive steps or not. This is accomplished by detecting that the sensor lever 40*a* begins to open the light path of the optical detector 40*b* or not. This state is similar to the case in which the result of step S31 is affirmative. Thus, the supply shaft 26 is stopped at a predetermined position through steps S33 and S34.

Also, if the result in steps S33 and S37 is negative, the process proceeds to steps S35 and S39 for judging whether the number of steps of the supply motor is larger than a predetermined maximum value or not. If the result of this judgement is affirmative, it is judged that the sheet has jammed or the motor has gone out of step, and an alarm is issued in steps S36 and S40. If the result of step S24 is negative, the decision in step S23 is repeated.

Figure 17:
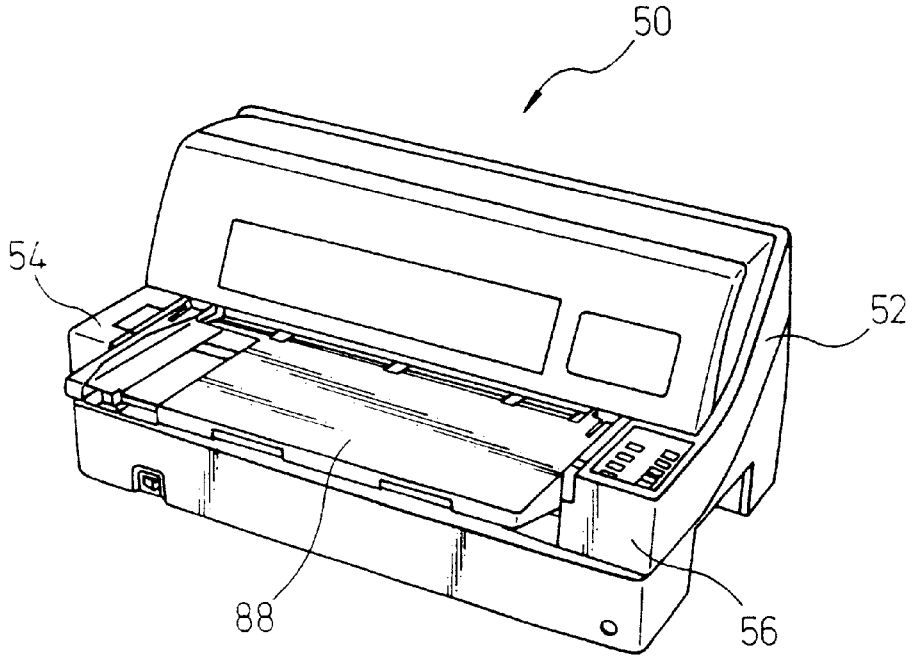
FIG. 17 is a view showing an example in which the table is mounted to the casing of the printer of FIGS. 1 and 2, instead of the sheet supply apparatus.
Figure 18:
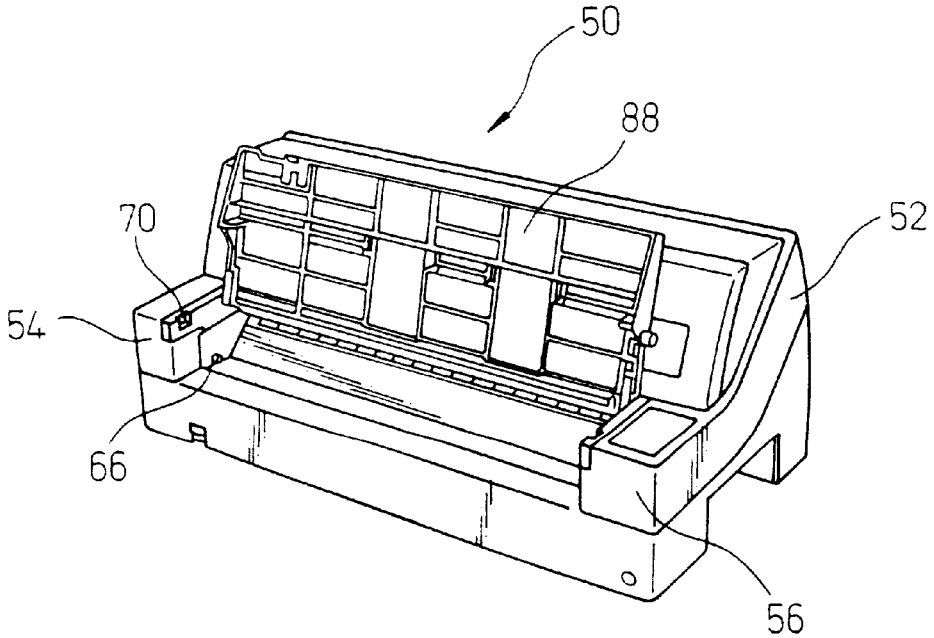
FIG. 18 is a view showing the table of FIG. 17 in a substantially vertical mounting/demounting position.

FIGS. 17 and 18 show an example in which a table 88 is mounted to the casing 52 of the printer 50 instead of the sheet supply apparatus 10. In FIG. 17, the table 88 is in a substantially horizontal operating position, and in FIG. 18, the table 88 is in a substantially vertical mounting/demounting position.

As explained with reference to FIG. 2, studs 64 and 66 constituting means for mounting the sheet supply apparatus 10 are arranged in the inner surface of the front side walls 54 and 56 of the casing 52 of the printer 50. Also, recesses 68, 70 are formed for mounting the table 88. In the case where the sheet supply apparatus 10 is demounted from the printer 50, therefore, the table 88 can be mounted to the printer 50 using the recesses 68 and 70.

Figure 19:
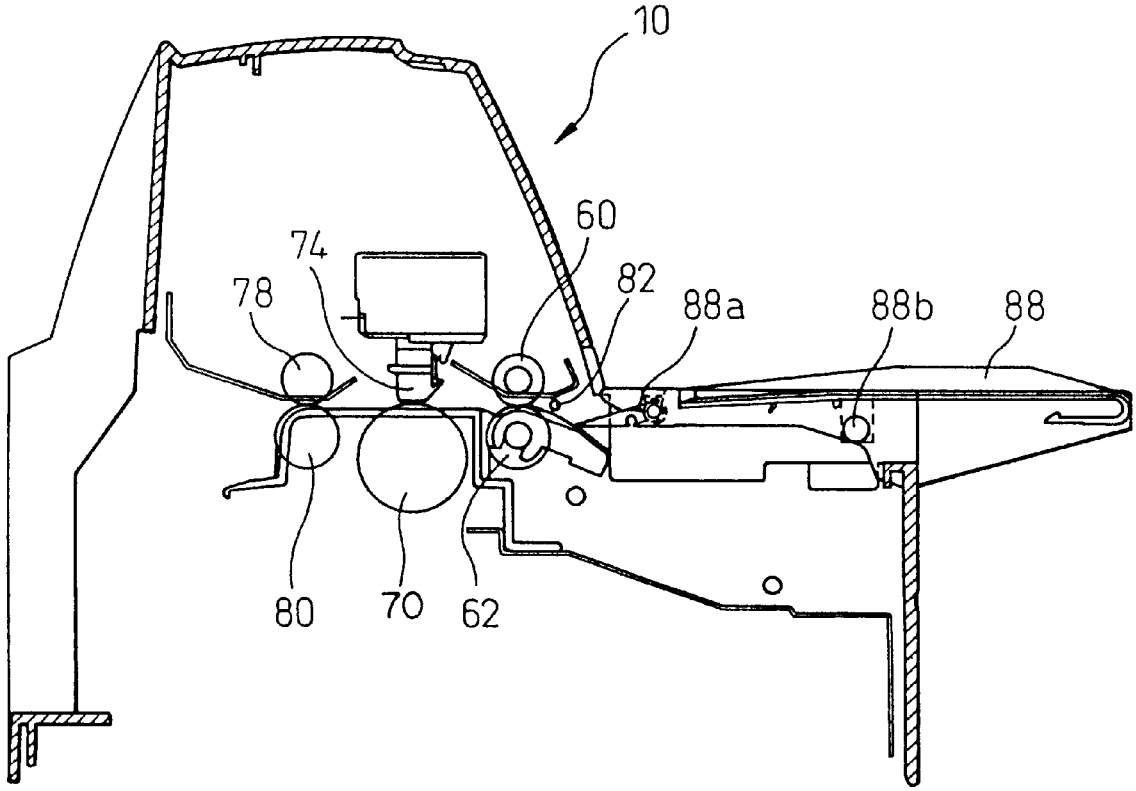
FIG. 19 is a cross-sectional view showing the interior of the table and the printer in the state corresponding to that of FIG. 17.
Figure 20A:
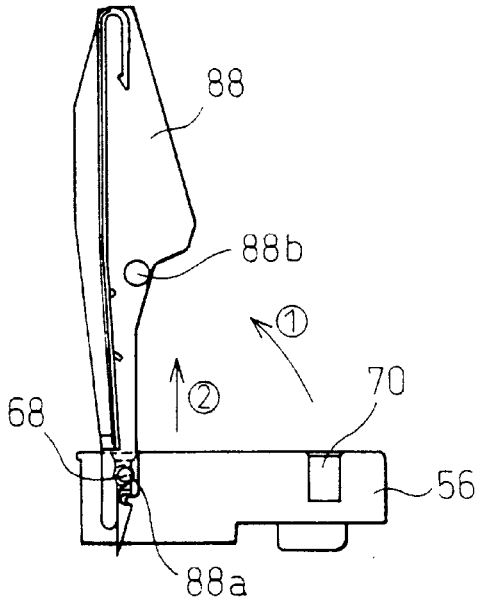
FIGS. 20A and 20B are views showing the case in which the table is mounted or demounted to or from the casing of the printer.
Figure 20B:
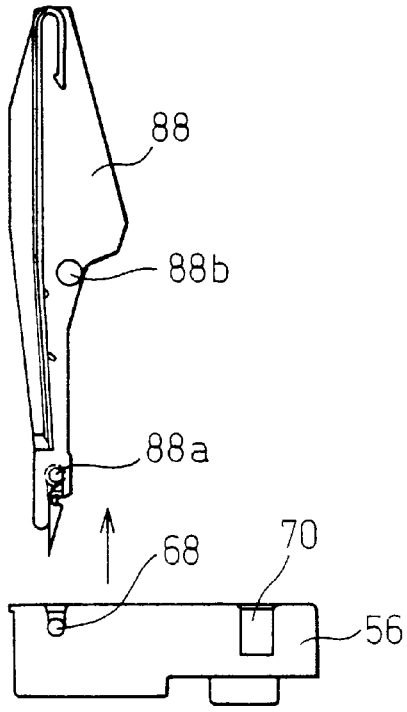

FIG. 19 shows the interior of the printer 10 and the table 88 corresponding to FIG. 17. As seen from the drawing, the sheet can be supplied manually from the table 88 toward the sheet conveying rollers 60 and 62. FIGS. 20A and 20B show the case in which the table 88 is mounted or demounted to or from the printer 50. As is clear from FIGS. 20A and 20B, the table 88 has a pin 88*a* adapted to engage the recess 68 in the inner surface of the front side walls 54 and 56, and a pin 88*b* adapted to engage the recess 70 in the inner surface of the front side walls 54 and 56 of the casing 52.

As shown in FIGS. 19 to 20A, the pin 88*b* comes off from the recess 70 when the table 88 is moved from the horizontal position to the vertical position. As shown in FIGS. 20A to 20B, the pin 88*a* comes off from the recess 68 when the table 88 is lifted upward vertically. In this way, the table 88 can be demounted from the printer 50. Also, the table 88 can be mounted to the printer 50 in reverse order.

In the case where the existing printer 50 is formed in such a manner that the table 88 is mounted thereon, therefore, the provision of the studs 64 and 66 in the casing 52 makes it possible to mount the sheet supply apparatus 10. The existing printer 50 includes the sheet conveying rollers 60 and 62, the conveying sheet sensor 82 and the sheet upper end sensors 84. The sheet supply apparatus 10 is designed to use these members so that the configuration of the sheet supply apparatus 10 can be simplified.

Further, in the case where the existing printer 50 is formed in such a manner that the table 88 is mounted thereto and the casing 52 includes the studs 64 and 66, then the sheet supply apparatus 10 can be mounted directly to the existing printer 50.

Figure 21:
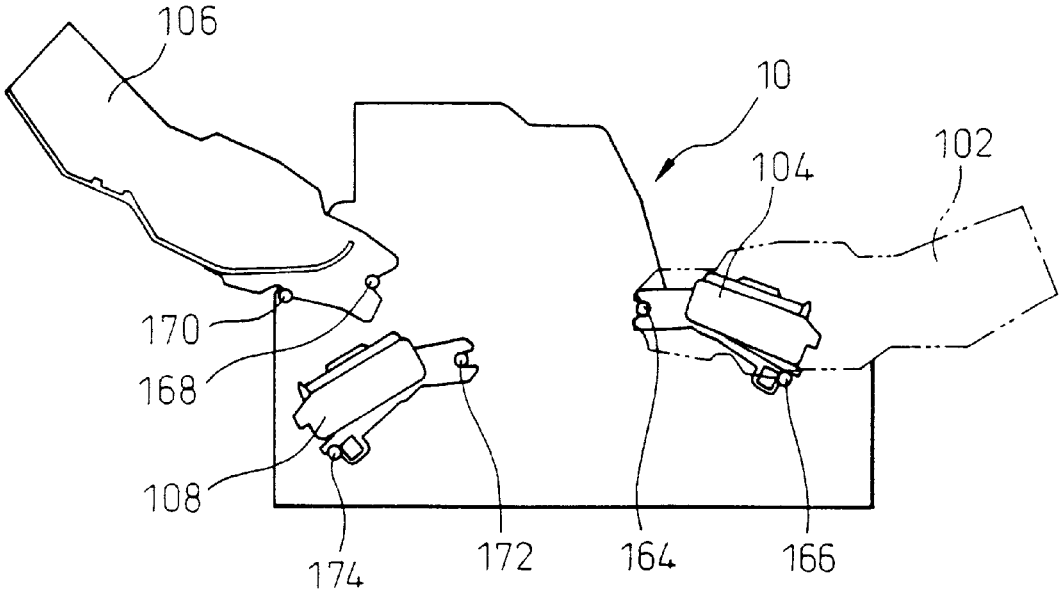
FIG. 21 is a schematic view showing an example of the printer having studs for mounting the sheet supply apparatus.

The printer described in JP-A-9-188016 proposed by the applicant of the present specification is formed to include the studs usable as the studs 64 and 66. This printer is schematically shown in FIG. 21. In FIG. 21, the printer 10 is so configured that a front cut sheet feeder 102, a front tractor 104 for connected successive sheets, a rear cut sheet feeder 106 and a rear tractor 108 for connected successive sheets, as well as a table (not shown), can be mounted thereon.

The printer 10 includes front studs 164 and 166. The front cut sheet feeder 102 or the front tractor 104 can be mounted on the printer 10 using the studs 164 and 166. These studs 164 and 166 are arranged in the same configuration as the studs 64 and 66 for mounting the sheet supply apparatus 10 of the present application. Consequently, the sheet supply apparatus 10 according to the present application can be mounted on the printer 10. Also, the printer 10 includes rear studs 168 and 170 and studs 172 and 174. The rear cut sheet feeder 106 can be mounted on the printer 10 by the studs 168 and 170, and the rear tractor 108 can be mounted on the printer 10 by the studs 172 and 174.

Further, as shown in FIGS. 6 and 19, the printer 10 includes first sheet conveying rollers 60 and 62 on one side of the platen and the printing head 74, and second sheet conveying rollers 78 and 80 on the other side of the platen and the printing head 74. The first sheet conveying rollers 60 and 62 and the second sheet conveying rollers 78 and 80 are rotated at the same rotational speed. Though not shown in FIG. 21, the printer 10 of FIG. 21 similarly includes the first sheet conveying rollers 60 and 62 and the second sheet conveying rollers 78 and 80. In this way, the sheet supplied from the front cut sheet feeder 102 or the front tractor 104 can be delivered to the rear side, or the sheet supplied from the rear cut sheet feeder 106 or the rear tractor 108 can be ejected to the front side of the printer. Further, the sheet supplied from the front side of the printer can be ejected the to the front side thereof. In a similar fashion, the sheet supplied from the rear side of the printer 10 can be ejected to the rear side of the printer 10.

As described above, according to the present invention, an inexpensive sheet supply apparatus and a recording apparatus having a small number of parts can be obtained, in which sheets are supplied by a single supply roller having a plurality of protrusions, and the oblique feeding of the sheets can be corrected.

What is claimed is:

1. A sheet supply apparatus comprising:

a frame having an upper wall, which forms a sheet conveying surface, and defining a sheet conveying direction;

a straight shaft rotatably arranged above said sheet conveying surface;

a plurality of protrusions arranged on said shaft in an axially spaced relationship and at circumferentially different angles with respect to said shaft;

said sheet conveying surface having a depression corresponding to the position of each of said protrusions; and a rotating device for rotating said shaft, said protrusions being arranged to convey a sheet in one direction.

2. A sheet supply apparatus comprising:

a frame having a sheet conveying surface and defining a sheet conveying direction;

a shaft rotatable arranged above said sheet conveying surface;

a plurality of protrusions arranged on said shaft in an axially spaced relationship and at circumferential different angles with respect to said shaft;

a rotating device for rotating said shaft whereby oblique feeding of a sheet is corrected by conveying the sheet by said protrusions along said sheet conveying surface toward a transverse member extending perpendicular to the sheet conveying direction so as to cause said sheet to abut against said transverse member;

configured rollers each having a hub held on said shaft and at least one lobe portion protruding from said hub said protrusions being formed on said lobe portions;

said at least one lobe portion comprising two lobe portions extending from said hub in diametrically opposed directions of said shaft; and said shaft having an angular range in which none of said lobe portions are brought into contact with the sheet moving along said sheet conveying surface.

3. A sheet supply apparatus comprising:

a frame having a sheet conveying surface and defining a sheet conveying direction;

a shaft rotatable arranged above said sheet conveying surface;

a plurality of protrusions arranged on said shaft in an axially spaced relationship and at circumferential different angles with respect to said shaft;

a rotating device for rotating said shaft whereby oblique feeding of a sheet is corrected by conveying the sheet by said protrusions along said sheet conveying surface toward a transverse member extending perpendicular to the sheet conveying direction so as to cause said sheet to abut against said transverse member; and said shaft having an angular range in which none of said protrusions are brought into contact with a sheet moving along said sheet conveying surface.

4. A sheet supply apparatus comprising:

a frame having a sheet conveying surface and defining a sheet conveying direction;

a shaft rotatable arranged above said sheet conveying surface;

a plurality of protrusions arranged on said shaft in an axially spaced relationship and at circumferential different angles with respect to said shaft;

a rotating device for rotating said shaft, whereby oblique feeding of a sheet is corrected by conveying the sheet by said protrusions along said sheet conveying surface toward a transverse member extending perpendicular to the sheet conveying direction so as to cause said sheet to abut against said transverse member, and a sheet sensor arranged in the vicinity of said shaft.

5. A sheet supply apparatus comprising:

a frame having a sheet conveying surface and defining a sheet conveying direction;

a shaft rotatably arranged above said sheet conveying surface;

a plurality of protrusions arranged on said shaft in an axially spaced relationship and at circumferential different angles with respect to said shaft;

a rotating device for rotating said shaft, whereby oblique feeding of a sheet is corrected by conveying the sheet by said protrusions along said sheet conveying surface toward a transverse member extending perpendicular to the sheet conveying direction so as to cause said sheet to abut against said transverse member, and a phase sensor for detecting the rotational position of said shaft.

6. A recording apparatus comprising a casing, a movable carriage, a printing head mounted to said carriage, a platen opposed to said printing head, a first pair of sheet conveying rollers arranged on one side of said platen, and a sheet supply apparatus arranged to supply a sheet toward said sheet conveying rollers;

said sheet supply apparatus comprising a frame mounted to said casing the frame having an upper wall, which forms a sheet conveying surface, and defining a sheet conveying direction, a straight shaft arranged rotatably above said sheet conveying surface, a plurality of protrusions formed on said shaft in the axially spaced relationship and at circumferentially different angles with respect to said shaft, said sheet conveying surface having a depression corresponding to the position of each of said protrusions and a rotating device for rotating said shaft, said protrusions being arranged to convey a sheet in one direction whereby oblique feeding of said sheet is corrected by conveying the sheet by said protrusions along said sheet conveying surface toward said pair of sheet conveying rollers so as to cause said sheet to abut against said pair of sheet conveying rollers.

7. A recording apparatus as described in claim 6, characterized in that said casing includes attaching means for removably attaching the frame of said sheet supply apparatus.

8. A recording apparatus as described in claim 6, further comprising a pair of second sheet conveying rollers arranged on the other side of said platen, a pair of said first sheet conveying rollers and a pair of said second sheet conveying rollers are driven in the same direction at the same rotational speed.

9. A recording apparatus comprising a casing, a movable carriage, a printing head mounted to said carriage, a platen opposed to said printing head, a pair of sheet conveying rollers arranged on one side of said platen, and a sheet supply apparatus arranged to supply a sheet toward said sheet conveying rollers;

said sheet supply apparatus comprising a frame mounted to said casino and having a sheet conveying surface and defining a sheet conveying direction, a shaft arranged rotatable above said sheet conveying surface, a plurality of protrusions formed on said shaft in the axially spaced relationship and at circumferentially different angles with respect to said shaft, and a rotating device for rotating said shaft whereby oblique feeding of said sheets is corrected by conveying the sheet by said protrusions alone said sheet conveying surface toward said pair of sheet conveying rollers so as to cause said sheet to abut against said pair of sheet conveying rollers, and a first sheet sensor arranged in the vicinity of said shaft, a second sheet sensor arranged in the vicinity of a pair of said sheet conveying rollers, and a third phase sensor for detecting the rotational position of said shaft.

10. A recording apparatus as described in claim 9, characterized in that when said first sheet sensor detects a sheet in said sheet supply apparatus, said shaft is rotated in accordance with the output of said first sheet sensor and the sheet is conveyed toward a pair of said sheet conveying rollers by said protrusions.

11. A recording apparatus as described in claim 9, characterized in that after the sheet is caused to abut against a pair of said sheet conveying rollers, the sheet is conveyed by a predetermined amount by said protrusions and a pair of said sheet conveying rollers, and subsequently the sheet is further conveyed only by a pair of said sheet conveying rollers.

12. A recording apparatus as described in claim 9, characterized in that each of said protrusions is formed as a lobe portion of a configurated roller having a hub held on said shaft and at least two lobe portion protruding from said hub in diametrically opposite directions of said shaft, said shaft has an angular range in which none of said lobe portions is in contact with the moving sheet along said sheet conveying surface, and upon completion of supply and eject of a sheet, said shaft is set in phase with the position in said angular range based on the output of said third phase sensor.

13. A recording apparatus as described in claim 12, characterized in that upon detection of said oblique feeding, the sheet is ejected to said sheet supply apparatus, and the sheet is resupplied by said sheet supply apparatus.

14. A recording apparatus comprising a casing, a movable carriage, a printing head mounted on said carriage, a pair of sheet sensors located in the vicinity of said printing head, a platen opposed to said printing head, a pair of sheet conveying rollers arranged on one side of said platen, and a sheet supply apparatus arranged to supply a sheet toward said sheet conveying rollers;

said recording apparatus further comprising a motor for driving said sheet conveying rollers, and a control device for controlling said motor with step numbers;

said sheet supply apparatus comprising a frame mounted on said casing the frame having an upper wall, which forms a sheet conveying surface, for feeding said sheets along said sheet conveying surface toward said pair of sheet conveying rollers so as to cause said sheet to abut against said pair of sheet conveying rollers, and means for detecting oblique feeding of said sheet by the difference between the step number of the motor when one of the sheet sensors detects the upper edge of the sheet and the step number of the motor when the other sheet sensor detects the upper edge of the sheet, while said sheet is conveyed by said sheet conveying rollers after the oblique feeding of said sheet is corrected.

15. A sheet supply apparatus comprising:

a frame having a sheet conveying surface and defining a sheet conveying direction;

a straight shaft rotatably arranged above said sheet conveying surface;

a plurality of protrusions arranged on said shaft in an axially spaced relationship and at circumferentially different angles with respect to said shaft;

a rotating device for rotating said shaft, said protrusions being arranged to convey a sheet in one direction, whereby oblique feeding of a sheet is corrected by conveying the sheet by said protrusions along said sheet conveying surface toward a transverse member extending perpendicular to the sheet conveying direction so as to cause said sheet to abut against said transverse member; and configured rollers, each having a hub held on said shaft and at least one lobe portion protruding from said hub, said protrusions being formed as said lobe portions.

16. A sheet supply apparatus as described in claim 15, characterized in that said at least one lobe portion comprises two lobe portions extending from said hub in diametrically opposed directions of said shaft.

17. A sheet supply apparatus comprising:

a frame having a sheet conveying surface and defining a sheet conveying direction;

a straight shaft rotatably arranged above said sheet conveying surface;

a plurality of protrusions arranged on said shaft in an axially spaced relationship and at circumferentally different angles with respect to said shaft;

a rotating device for rotating said shaft, said protrusions being arranged to convey a sheet in one direction, whereby oblique feeding of a sheet is corrected by conveying the sheet by said protrusions along said sheet conveying surface toward a transverse member extending perpendicular to the sheet conveying direction so as to cause said sheet to abut against said transverse member; and wherein said sheet conveying surface has a depression corresponding to the position of each of said protrusions.

18. A sheet supply apparatus comprising:

a frame having a sheet conveying surface and defining a sheet conveying direction;

a straight shaft rotatably arranged above said sheet conveying surface;

a plurality of protrusions arranged on said shaft in an axially spaced relationship and at circumferentially different angles with respect to said shaft;

a rotating device for rotating said shaft, said protrusions being arranged to convey a sheet in one direction, whereby oblique feeding of a sheet is corrected by conveying the sheet by said protrusions along said sheet conveying surface toward a transverse member extending perpendicular to the sheet conveying direction so as to cause said sheet to abut against said transverse member; and wherein said sheet conveying surface has at least one pad for braking the sheet when it is ejected.

* * * * *